US009881437B2

(12) United States Patent
Sato

(10) Patent No.: US 9,881,437 B2
(45) Date of Patent: Jan. 30, 2018

(54) MONEY RECEPTION DEVICE

(71) Applicant: TOSHIBA TEC KABUSHIKI KAISHA, Tokyo (JP)

(72) Inventor: Yusuke Sato, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/392,689

(22) Filed: Dec. 28, 2016

(65) Prior Publication Data

US 2017/0206726 A1 Jul. 20, 2017

(30) Foreign Application Priority Data

Jan. 20, 2016 (JP) ..... 2016-008523

(51) Int. Cl.
*G07D 5/02* (2006.01)
*G07D 5/00* (2006.01)
*G07D 9/00* (2006.01)

(52) U.S. Cl.
CPC ..... *G07D 5/02* (2013.01); *G07D 5/00* (2013.01); *G07D 9/002* (2013.01)

(58) Field of Classification Search
CPC ..... G07D 5/00; G07D 5/02; G07D 9/002
USPC ..... 235/7 A, 7 R
See application file for complete search history.

(56) References Cited

U.S. PATENT DOCUMENTS 3,680,566 A * 8/1972 Tanaka ..... G07D 9/008 194/219
2010/0015903 A1* 1/2010 Nishida ..... G07D 9/008 453/57

FOREIGN PATENT DOCUMENTS

JP 2015052845 A 3/2015

* cited by examiner

*Primary Examiner* — Toan Ly
(74) *Attorney, Agent, or Firm* — Patterson & Sheridan, LLP

(57) ABSTRACT

In one embodiment, a money reception device has a storage device, a reject device, and a control device. The reject device rejects money which has been judged not to be a normal coin, out of received coins. After the money has been rejected, when storage of the money to be received again in the storage device is permitted, the control device controls the reject device so that the money to be received again is not rejected.

14 Claims, 10 Drawing Sheets

542

| | | 1 YEN COIN | 5 YEN COIN | 10 YEN COIN | 50 YEN COIN | 100 YEN COIN | 500 YEN COIN |
|---|---|---|---|---|---|---|---|
| 5421 | OUTER DIAMETER DATA PORTION | A1～A2 | | | | | |
| 5422 | MATERIAL DATA PORTION | B1～B2 | | | | | |
| 5423 | THICKNESS DATA PORTION | C1～C2 | | | | | |

Fig.5

MONEY RECEPTION DEVICE

CROSS-REFERENCE TO RELATED APPLICATION

This application is based upon and claims the benefit of priority from the prior Japanese Patent Application No. 2016-008523, filed on Jan. 20, 2016, the entire contents of which are incorporated herein by reference.

FIELD

Embodiments described herein relate generally to a money reception device.

BACKGROUND

Recently, in a distribution retail store, such as a supermarket, a department store, a restaurant, a money reception device which receives and stores a coin or a bill (hereinafter, a coin and a bill are collectively called "money") deposited from a customer has been used. This money reception device performs discrimination of the money and determination of authenticity of the money in the process of storing received money, and rejects the money which has not been determined to be a normal coin.

By the way, a money reception device does not determine money to be a normal coin, for wear or blot of the money, regardless that it is a normal coin, and may reject the money. In such a case, an operator manages to deposit substitute money which has been previously prepared in a storage or the like, in the money reception device.

Accordingly, a store had to prepare a storage for such money or reserve.

BRIEF DESCRIPTION OF THE DRAWINGS

FIG. 5 is a diagram showing the normal coin information unit to store normal data ranges for coin discrimination according to the embodiment.

DETAILED DESCRIPTION

Figure 1:
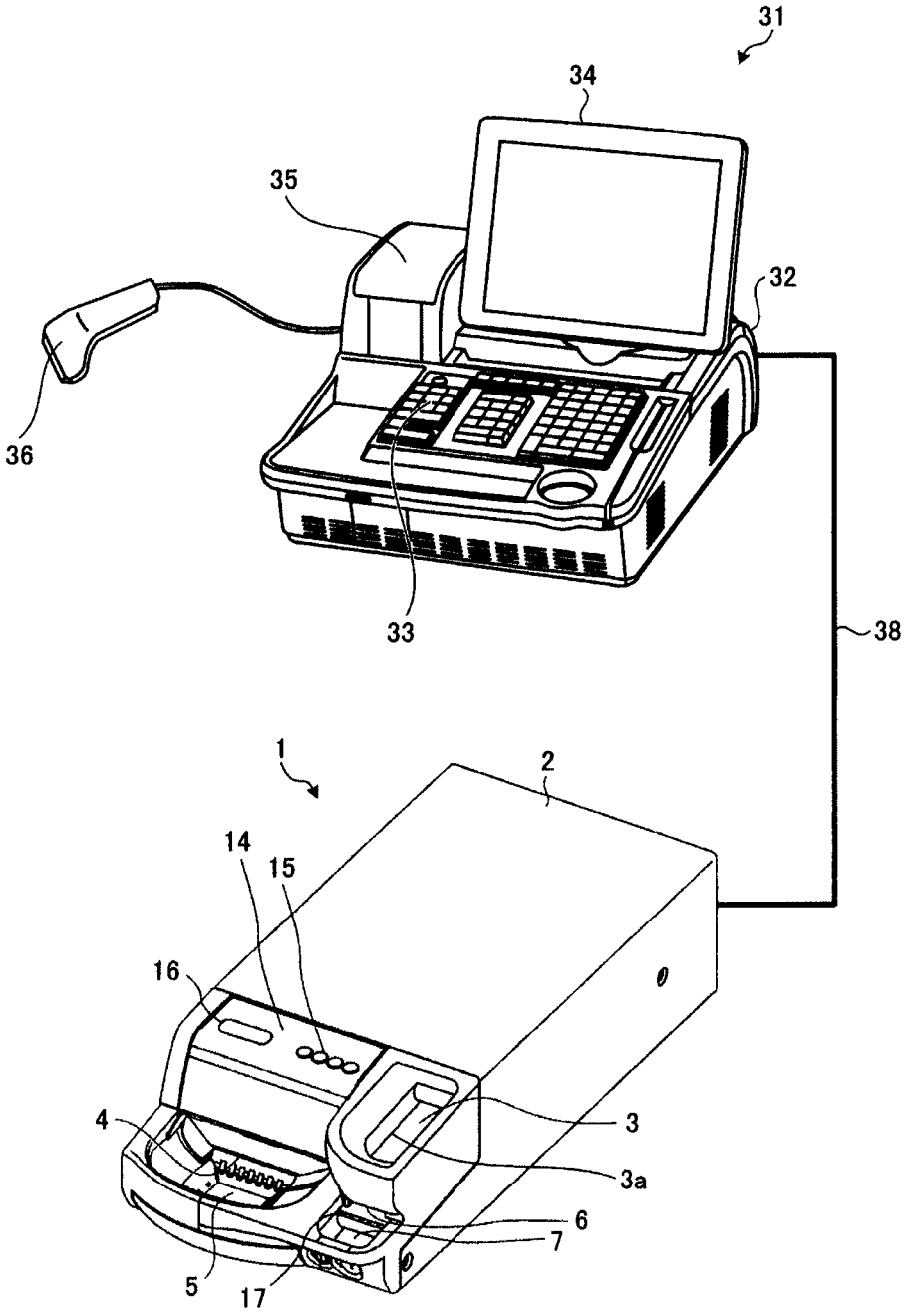
FIG. 1 is a diagram schematically showing a system including a POS terminal and a coin change machine according to an embodiment.

According to one embodiment, a money reception device has a received money conveying device, a storage device, a first detection device, a reject device, an interface, and a control device. The received money conveying device conveys received money via a conveying path. The storage device stores the money to be conveyed by the conveying device. The first detection device detects characteristic of the money to be conveyed by the conveying device. The reject device rejects the money that has been judged not to be a normal coin out of the moneys to be conveyed by the conveying device, from the conveying path. The interface receives storage permission to permit storing of the money to be received again, after the money has been rejected from the conveying path by the reject device, in the storage device. The control device judges whether the money is not a normal coin, based on a detection result of the first detection device. The control device controls the reject device so that the money which has been judged not to be a normal coin is rejected from the conveying path, when it is judged that the money is not a normal coin. The control device controls the reject device so that the money to be received again passes through the conveying path without being rejected, when the interface has received the storage permission.

Hereinafter, money reception devices according to embodiments will be described in detail with reference to FIG. 1 to FIG. 10. In the drawings, the same symbols indicate the same or similar portions. In the embodiment, a coin change machine which executes a money reception/payment processing of a coin will be described as an example of a money reception device. In addition, a coin will be described as an example of money. In addition, the embodiment is not limited to the following description.

FIG. 1 is a diagram showing a system according to an embodiment. In FIG. 1, the system has a POS (Point of Sales) terminal 31 that is an external device, and a coin change machine 1. The POS terminal 31 and the coin change machine 1 are electrically connected by a communication cable 38 such as a USB (Universal Serial Bus) cable. The POS terminal 31 has a power source unit and a circuit board and so on in a main body 32. In addition, the POS terminal 31 has an operation device 33, a display device for operator 34, a printing device 35, a reading device 36 and so on.

The operation device 33 is a keyboard for inputting information. The keyboard includes a settlement key 331 (refer to FIG. 3) which an operator operates. The settlement key 331 includes a deposit/cash settlement key, and a credit settlement key, for example. The settlement key 331 is operated by an operator, at the time of finishing the transaction with a customer (finishes sales to a customer). The display device for operator 34 has a liquid crystal screen, for example. The display device for operator 34 displays information for an operator who operates the POS terminal 31, such as commodity information. In addition, the display device for operator 34 displays a screen for an operator, such as a storage permission request screen 341 (refer to FIG. 9) described later and a money payment permission request screen 345 described later. In addition, the reading device 36 reads a code symbol such as a bar code which has been pasted or printed on a commodity. The POS terminal 31 acquires a commodity code from the read code symbol. The POS terminal 31 calls out commodity information corresponding to the acquired commodity code from a commodity master not shown, and displays it on the display device for operator 34. In addition, the printing device 35 is a thermal printer, for example. The printing device 35 issues a receipt printed with commodity information and so on. In addition, the POS terminal 31 has a display device for customer 37, in addition to the display device for operator 34

Figure 3:
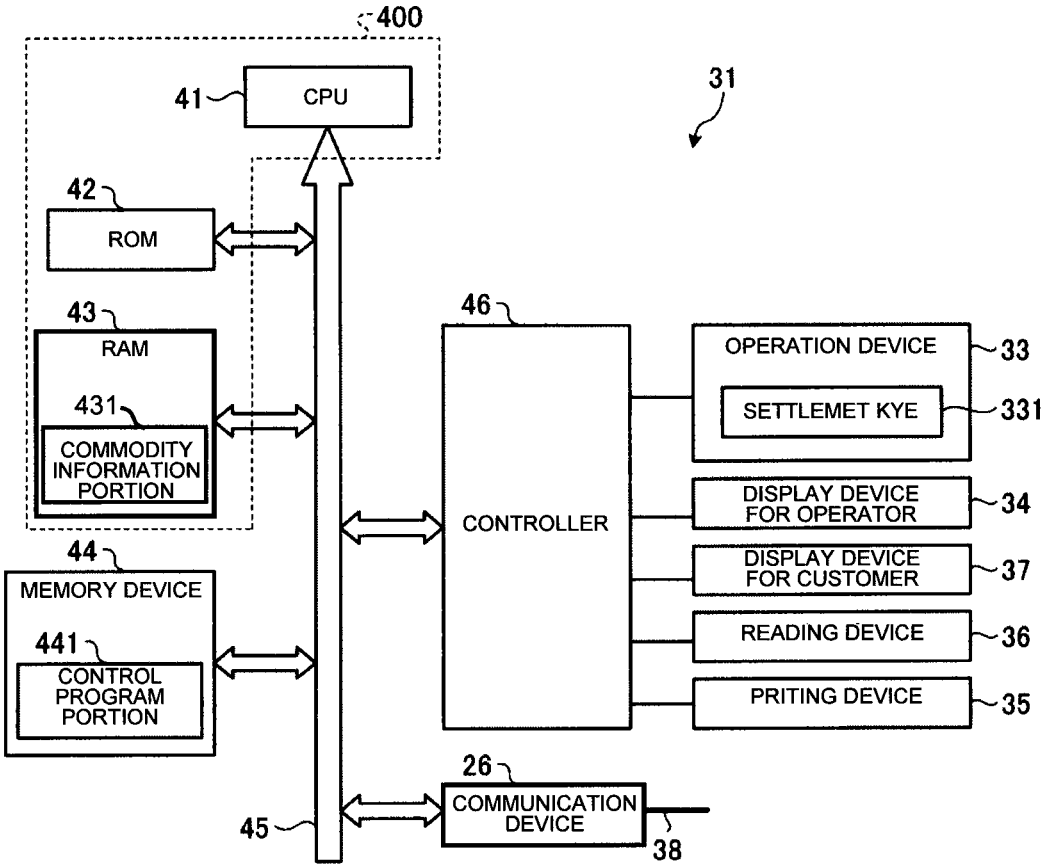
FIG. 3 is a block diagram showing a hardware configuration of the POS terminal according to the embodiment.

(refer to FIG. 3). The display device for customer 37 is provided at a side opposite to the display device for operator 34, and has a liquid crystal screen, for example. The display device for customer 37 displays information for a customer who purchases a commodity.

On the other hand, the coin change machine 1 has a chassis 2 which is long in the depth direction. A coin input port 3 opening upward is provided on the upper surface of the chassis 2 shown in FIG. 1 at the front right side. The coin input port 3 is a port where a coin to be received into the chassis 2 is inputted. A plurality of coins can be inputted in the coin input port 3 at the same time. The coin change machine 1 has a take-in and conveying device 3*a*. The take-in and conveying device 3*a* conveys coins received by the coin input port 3 one by one, and takes in the coins into the chassis 2. The take-in and conveying device 3*a* includes a flat belt, for example. The flat belt is provided on a receiving surface to receive the coin inputted from the coin input port 3. The flat belt is rotated by a motor not shown. The flat belt is rotated, to convey the coins inputted in the coin input port 3 toward the inside of the chassis 2 one by one, and to take in the coins into the inside of the chassis 2. That is, the coin inputted in the coin input port 3 is received into the coin change machine 1 by the take-in and conveying device 3*a*. Hereinafter, the take-in and conveying device 3*a* is simply called a flat belt 3*a*.

A coin paying port 4 is provided on the front surface of the chassis 2 at the left side. The coin paying port 4 is a port to output (pay) the change into the outside of the chassis 2. At the front side of the coin paying port 4 of the chassis 2, a saucer 5 to receive the coin which has been paid from the coin paying port 4 is provided.

In addition, at the lower front side of the coin input port 3 of the chassis 2, a reject port 6 for discharging a coin which is not to be stored in the coin change machine 1, such as a deformed coin, a foreign coin, a counterfeit coin, and a commemorative coin is provided. A saucer 7 to catch a coin discharged from the reject port 6 is provided on the chassis 2 at the front side of the reject port 6. The coin change machine 1 discharges a coin which has been rejected by a reject device 11 described later from the reject port 6. In the embodiment, a coin which may be stored in the coin change machine 1, that is, a coin except a deformed coin, a foreign coin, a counterfeit coin, and a commemorative coin which have been described above is called a normal coin.

A plurality of LEDs 17 for informing that a coin is to be discharged from the reject port 6 are provided in parallel with each other at the inside of the saucer 7 in the vicinity of the reject port 6. In addition, the place where the LEDs 17 are provided is not particularly limited, as long as it is in the vicinity of the reject port 6. The number of the LEDs 17 and the arrangement thereof are also not particularly limited. When the above described rejected coin is discharged from the reject port 6, the LEDs 17 are lighted (blinking light emitting may be used). The LEDs 17 are lighted, and thereby an operator easily notices that a coin is to be discharged from the reject port 6.

An operation device 14 is provided on the upper surface of the chassis 2 shown in FIG. 1 at the front left side. The operation device 14 has operation keys 15 including a button which starts a money payment (paying) operation of the change, and so on. Further, the operation device 14 has a display device 16 which displays an amount of received money, an amount of paying money, an error message, and so on.

Figure 2:
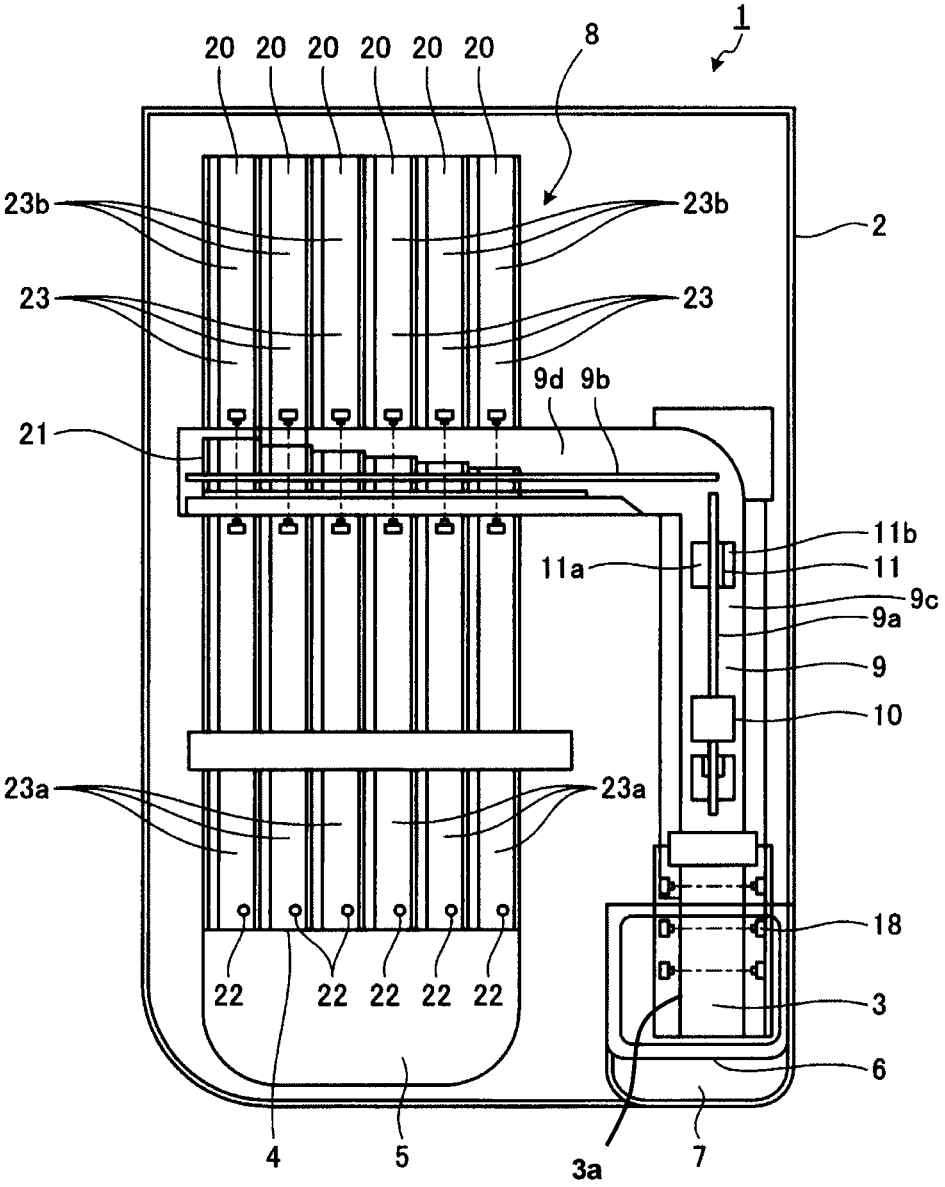
FIG. 2 is a plan view showing an internal configuration of the coin change machine according to the embodiment.

FIG. 2 is a plan view schematically showing an internal structure of the coin change machine 1. The coin change machine 1 has a coin detection device 18 provided at the lower surface portion of the coin input port 3. In addition, the coin change machine 1 has a storage device 8, a received money conveying device 9, a received money discrimination device 10, and the reject device 11 inside the chassis 2.

The coin detection device 18 has three pairs of transmission type sensors, for example. The coin detection device 18 detects a coin inputted in the coin input port 3. When the coin is detected by the coin detection device 18, the coin change machine 1 drives the flat belt 3*a*, to convey the coin to the inside of the chassis 2 and to receive the coin. The received coin is conveyed to a further inside of the chassis 2 by the received money conveying device 9.

The received money conveying device 9 sequentially conveys the coins which have been inputted from the coin input port 3 and received by the flat belt 3*a*, to the storage device 8 one by one at a prescribed interval. The received money conveying device 9 has conveying belts 9*a*, 9*b*, and conveying paths 9*c*, 9*d*, for example. The conveying path 9*c* is a path which is arranged in the direction along the conveying direction of a coin by the flat belt 3*a*. The conveying path 9*c* leads the coin which has been conveyed by the flat belt 3*a* in the same direction as the conveying direction of a coin by the flat belt 3*a*. The conveying belt 9*a* is arranged along the conveying path 9*c*. The conveying belt 9*a* conveys the coin via the conveying path 9*c*. The conveying path 9*d* is a path arranged orthogonally to the conveying path 9*c*. The conveying path 9*d* leads the coin to be conveyed by the conveying belt 9*a* and the conveying path 9*c* to the upper portion of the storage device 8. The conveying belt 9*b* is arranged along the conveying path 9*d*. In other words, the conveying belt 9*b* is arranged orthogonally to the conveying belt 9*a*. The conveying belt 9*b* conveys the coin via the conveying path 9*d*.

Accordingly, the coin inputted from the coin input port 3 is conveyed on the conveying path 9*c* inside the coin change machine 1 by the conveying belt 9*a*, and is passed onto the conveying belt 9*b*. Then, the coin is conveyed on the conveying path 9*d* to the upper portion of the storage device 8 by the conveying belt 9*b*. The storage device 8 has a plurality of storages 20 corresponding to denominations of coins. The storage device 8 stores coins in the storages 20 for the respective denominations. Specifically, the storage device 8 has a plurality of sorting holes 21. The sorting holes 21 are arranged in the conveying path 9*d* at positions corresponding to the upper portions of the respective storages 20. The sorting holes 21 make the coins to be conveyed by the conveying belt 9*b* and the conveying path 9*d* drop in the respective storages 20 corresponding to the denominations of the relevant coins. For example, the sorting holes 21 have sizes corresponding to respective diameters of the coins to be dropped. Accordingly, when the coins which have been conveyed on the conveying path 9*d* by the conveying belt 9*b* pass through the sorting holes 21, only the coin having a size coincident with the sorting hole 21 drops from the sorting hole 21 into the storage 20. Accordingly, the coins which have dropped through the sorting holes 21 are sorted for the respective denominations, and are stored in the storages 20 of the corresponding denominations.

The received money discrimination device 10 that is a first detection device detects characteristic of a coin to be received. The received money discrimination device 10 outputs a voltage in accordance with the characteristic of the coin, as a detection result. The received money discrimination device 10 includes an outer diameter sensor, a material sensor, and a thickness sensor, for example. The outer diameter sensor detects, as the above-described characteristic of the coin, an outer diameter of the coin to pass through the received money discrimination device 10. The material sensor detects, as the above-described characteristic of the coin, material of the coin to pass through the received money discrimination device 10. The thickness sensor detects, as the above-described characteristic of the coin, a thickness of the coin to pass through the received money discrimination device 10. And the above-described respective sensors of the received money discrimination device 10 output in accordance with the detection results. In addition, a control device 100 described later judges the authenticity and denomination of the coin, based on the detection results from the received money discrimination device 10.

The reject device 11 is provided in the middle of the conveying path 9*c* at the more downstream side in the conveying direction of a coin than the received money discrimination device 10. The reject device 11 rejects the coin to be conveyed by the received money conveying device 9 from the conveying path 9*c*, or makes the coin pass through the conveying path 9*c* without rejecting it. Specifically, the reject device 11 has a reject hole 11*a* to make a coin drop, and a shutter 11*b* which can be opened and closed for this reject hole 11*a*. In the state that the shutter 11*b* is closed for the reject hole 11*a*, all the coins to be conveyed by the received money conveying device 9 are conveyed to the storage device 8 without dropping from the reject hole 11*a*. In the state that the shutter 11*b* is opened for the reject hole 11*a*, the coin to be conveyed by the received money conveying device 9 drops from the reject hole 11*a*, and is rejected from the conveying path 9*c*. The rejected coin is conveyed to the reject port 6, and is discharged from the reject port 6 on a saucer 7.

In addition, the coin change machine 1 has a paying money conveying device 23 and a paying money discrimination device 22. The paying money conveying device 23 has a paying route 23*a* and a paying belt 23*b*. The paying belt 23*b* conveys the coin stored in the storage 20 to the coin paying port 4 along the paying route 23*a*. The paying money discrimination device 22 that is a second detection device detects characteristics of the coin to be paid. The paying money discrimination device 22 outputs a voltage in accordance with the characteristic of the coin, as a detection result. The paying money discrimination devices 22 that are second detection devices are provided in the paying routes 23*a* immediately before the coin paying port 4 of the respective storages 20. The paying money discrimination device 22 has the same configuration as the received money discrimination device 10. That is, the paying money discrimination device 22 has an outer diameter sensor, a material sensor, and a thickness sensor. The outer diameter sensor detects, as the above-described characteristic of the coin, an outer diameter of the coin to pass through the paying money discrimination device 22. The material sensor detects, as the above-described characteristic of the coin, material of the coin to pass through the paying money discrimination device 22. The thickness sensor detects, as the above-described characteristic of the coin, a thickness of the coin to pass through the paying money discrimination device 22. And the above-described respective sensors of the paying money discrimination device 22 output in accordance with the detection results. In addition, the control device 100 described later judges the denomination and authenticity of the coin, based on the detection results from the paying money discrimination device 22. In addition, the paying money discrimination devices 22 are respectively provided by a plurality of numbers for a plurality of the storages 20. Accordingly, it is possible to judge from what storage 20 out of a plurality of the storages 20 the coin has been paid, by the detection results of the paying money discrimination devices 20. That is, since the respective storages 20 correspond to denominations, it is also possible to judge a denomination of the coin to be paid, by the detection results of the paying money discrimination devices 22.

Hereinafter, hardware configurations of the POS terminal 31 and the coin change machine 1 will be described. FIG. 3 is a block diagram showing a hardware configuration of the POS terminal 31. As shown in FIG. 3, the POS terminal 31 has a control device 400 and a memory device 44 and so on. The control device 400 has a CPU (Central Processing Unit) 41, a ROM (Read Only Memory) 42, and a RAM (Random Access Memory) 43. The CPU 41 is a processor serving as a control main constituent. The ROM 42 stores various programs. The RAM 43 expands various data. The memory device 44 stores various programs. The CPU 41, the ROM 42, the RAM 43, the memory device 44 are connected to each other via a data bus 45. That is, in the control device 400, the CPU 41 expands the control programs stored in the ROM 42 and the memory device 44 in the RAM 43. The control device 400 operates in accordance with the control programs expanded in the RAM 43, and thereby executes a control processing described later.

The RAM 43 includes a commodity information partition 431 to store commodity information. The memory device 44 is a nonvolatile memory in which memory information is held even if a power source is turned off, such as a HDD (Hard Disc Drive), or a flash memory. The memory device 44 includes a control program partition 441 to store the control program.

The control device 400 connects to the operation device 33, the display device for operator 34, the display device for customer 37, the reading device 36, and the printing device 35, via the data bus 45 and a controller 46.

In addition, the control device 400 connects to an interface 26 via the data bus 45. The interface 26 includes a communication device to perform communication via the communication cable 38. Hereinafter, the interface 26 is called a communication device 26. The communication device 26 performs transmission/reception of information with the coin change machine 1. For example, the communication device 26 transmits change information described later to the coin change machine 1. The communication device 26 receives a storage permission request signal described later and so on from the coin change machine 1, and transmits, as its response, a storage rejection signal or a storage permission signal which will be described later, to the coin change machine 1. Further, the communication device 26 receive a money payment permission request signal described later from the coin change machine 1, and transmits, as its response, a money payment rejection signal, or a money payment permission signal to the coin change machine 1.

Figure 4:
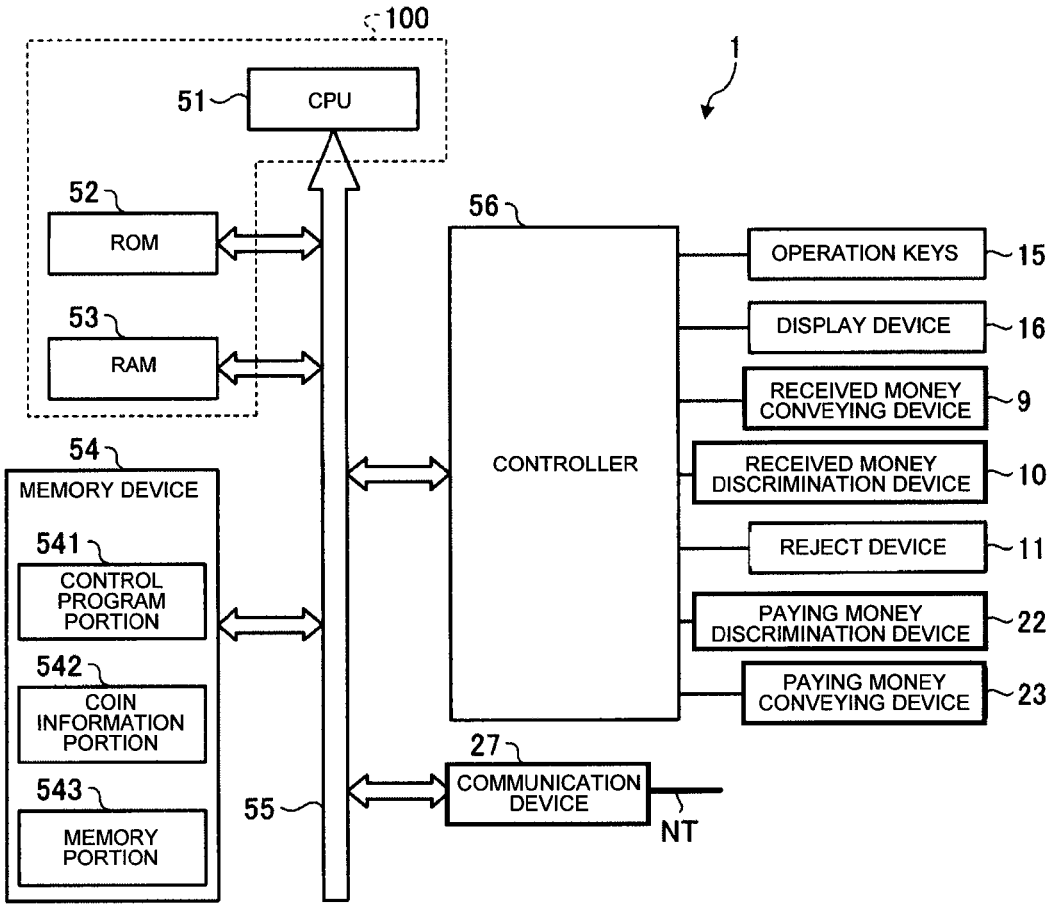
FIG. 4 is a block diagram showing a hardware configuration of the coin change machine according to the embodiment.

FIG. 4 is a block diagram showing a hardware configuration of the coin change machine 1. As shown in FIG. 4, the coin change machine 1 has a control device 100 and a memory device 54. The control device 100 has a CPU 51, a ROM 52 and a RAM 53. The CPU 51 is a processor serving as a control main constituent. The ROM 52 stores various programs. The RAM 53 expands various data. The memory device 54 stores various programs. The CPU 51, the ROM 52, the RAM 53, the memory device 54 are connected to each other via a data bus 55. That is, in the control device 100, the CPU 51 expands the control programs stored in the ROM 52 and the memory device 54 in the RAM 53. The control device 100 operates in accordance with the control programs expanded in the RAM 53, and thereby executes a control processing described later.

The memory device 54 is a nonvolatile memory in which memory information is held even if a power source is turned off, such as a HDD (Hard Disc Drive), or a flash memory. The memory device 54 includes a control program partition 541 to store the control program. Further, the memory device 54 includes a normal coin information partition 542 and a memory partition 543. The memory partition 543 stores an output from the received money discrimination device 10. That is, the memory partition 543 stores an output voltage from the outer diameter sensor, an output voltage from the material sensor, and an output voltage from the thickness sensor. Hereinafter, an output voltage from a sensor may be simply called an output from a sensor. The normal coin information partition 542 will be described later with reference to FIG. 5.

In addition, the control device 100 connects to the operation device 15, the display device 16, the received money conveying device 9, the received money discrimination device 10, the reject device 11, the paying money discrimination device 22, the paying money conveying device 23.

The received money conveying device 9 includes motors or the like for driving the conveying belts 9*a*, 9*b*. The reject device 11 includes a solenoid or the like which makes the shutter 11*b* perform opening and closing operations for the reject hole 11*a*. The paying money conveying device 23 includes a motor or the like to drive the paying belt 23*b*. The control device 100 inputs an output from the received money discrimination device 10. The control device 100 inputs an output from the paying money discrimination device 22.

In addition, the control device 100 connects to an interface 27 via the data bus 55. The interface 27 is a communication device to perform communication with the POS terminal 31 via the communication cable 38. Hereinafter, the interface 27 is called a communication device 27. The communication device 27 performs transmission/reception of information with the POS terminal 31. For example, the communication device 27 receives the change information described later from the POS terminal 31. The communication device 27 transmits the storage permission request signal described later or the like to the POS terminal 31, and receives, as its response, the storage permission signal described later or the storage rejection signal which will be described later from the POS terminal 31. In addition, the communication device 27 transmits the money payment permission request signal described later or the like to the POS terminal 31, and as its response, receives the money payment permission signal or the money payment rejection signal which will be described later, from the POS terminal 31

Next, the normal coin information partition 542 of the memory device 54 will be described. FIG. 5 is a diagram showing the normal coin information partition 542 to store normal data ranges for coin discrimination. The normal coin information partition 542 stores a normal data range for each denomination which is necessary for judgement as to whether or not the received coin (more precisely, a coin which passes through the received money discrimination device 10) is a normal coin, and judgement of the denomination of the received coin. The control device 100 judges whether or not the received coin is a normal coin and its denomination, based on the output from the received money discrimination device 10, and with reference to the above-described normal data ranges of the normal coin information partition 542. For example, outputs from the received money discrimination unit 10 are all within the above-described normal data ranges stored in the normal coin information partition 542, the control device 100 judges that the received coin is a normal coin.

As shown in FIG. 5, the normal coin information partition 542 includes an outer diameter data partition 5421, a material data partition 5422, and a thickness data partition 5423. The outer diameter data partition 5421 stores a normal data range corresponding to an output when the above-described outer diameter sensor of the received money discrimination device 10 detects a normal coin, for each denomination. For example, a normal data range of 1-yen coin which is stored in the outer diameter data partition 5421 is a data range of A1-A2. The material data partition 5422 stores a normal data range corresponding to an output when the above-described material sensor of the received money discrimination device 10 detects a normal coin, for each denomination. For example, a normal data range of 1-yen coin which is stored in the material data partition 5422 is a data range of B1-B2. The thickness data partition 5423 stores a normal data range corresponding to an output when the above-described thickness sensor of the received money discrimination device 10 detects a normal coin, for each denomination. For example, a normal data range of 1-yen coin which is stored in the thickness data partition 5423 is a data range of C1-C2.

Hereinafter, controls of the POS terminal 31 and the coin change machine 1 will be described, using FIG. 6 to FIG. 10.

Figure 6:
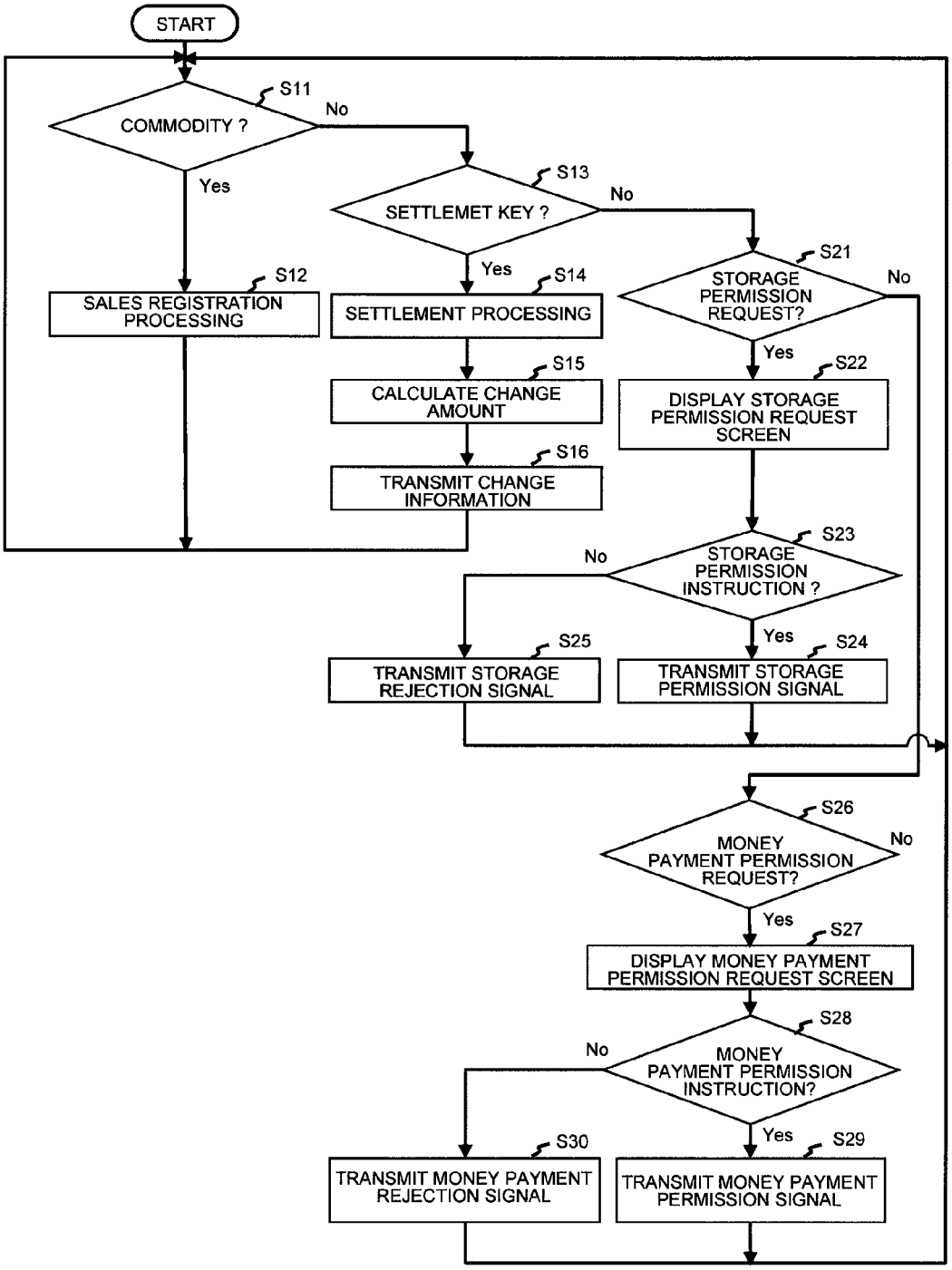
FIG. 6 is a flow chart showing a control processing of the POS terminal according to the embodiment.

To begin with, a control of the POS terminal 31 will be described. FIG. 6 is a flow chart showing a control processing of the POS terminal 31. As shown in FIG. 6, in a step S11, the control device 400 judges whether or not the reading device 36 has acquired a commodity code by reading a code symbol. When it is judged that the reading device 36 has acquired the commodity code (Yes in step S11), the processing of the control device 400 proceeds to a step S12. In the step S12, the control device 400 reads out commodity information (commodity name, price and so on) from a commodity master not shown, for example, based on the above-described acquired commodity code, and executes a sales registration processing. The sales registration processing includes a processing of the control device 400 which makes commodity information such as a commodity name and a price of a commodity to be sold to a customer to be displayed on the display device for operator 34 and the display device for customer 37. Further, the sales registration processing includes a processing of the control device 400 which makes the commodity information to be stored in the commodity information partition 431 of the RAM 43 (refer to FIG. 3). When the sales registration processing is finished, the processing of the control device 400 returns to the step S11.

On the other hand, when it is judged that the reading device 36 has not acquired the commodity code (No in step S11), the processing of the control device 400 proceeds to a step S13. In the step S13, the control device 400 judges whether or not the settlement key 331 has been operated. When it is judged that the settlement key has been operated (Yes in step S13), the processing of the control device 400 proceeds to a step S14. In the step S14, the control device 400 executes a settlement processing of the commodity subjected to the sales registration processing. The settlement processing includes a processing of the control device 400 which makes settlement information such as a total amount relating to the transaction with a customer, a deposit money deposited from the customer, and change, to be displayed on the display device for operator 34 and the display device for customer 37, based on the commodity information of the commodity subjected to the sales registration processing. Further, the settlement processing includes a processing of the control device 400 which makes the printing device 35 issue a receipt printed with the commodity information and the settlement information. In a step S15, the control device 400 calculates a change amount to be handed to the customer, from the deposit money from the customer and the total amount. In a step S16, the control device 400 transmits change information including a calculated change amount to the coin change machine 1, via the communication device 26 (step S16). When the processings of the above-described step S14 to step S16 are finished, the processing of the control device 400 return to the step S11.

In addition, when it is judged that the settlement key 331 has not been operated (No in step S13), the processing of the control device 400 proceeds to a step S21. In the step S21 (has storage permission request signal been received?), the control device 400 judges whether or not to have received a storage permission request signal described later from the coin change machine 1, via the communication device 26. When it is judged that the storage permission request signal has been received (Yes in step S21), the processing of the control device 400 proceeds to a step S22. In the step S22, the control device 400 displays the storage permission request screen 341 on the display device for operator 34. The storage permission request screen 341 to be displayed on the display device for operator 34 will be described later with reference to FIG. 9. Next, in a step S23, the control device 400 judges whether or not an operation to instruct storage permission has been performed, based on the storage permission request screen 341. When it is judged that the operation to instruct the storage permission has been performed (Yes in step S23), the processing of the control device 400 proceeds to a step S24. In the step S24, the control deice 400 transmits a storage permission signal to the coin change machine 1, using the communication device 26. In addition, the storage permission signal is a signal indicating storage permission which permits that the coin change machine 1 stores a coin to be received in the coin change machine 1 in the storage device 8. That is, the control device 400 transmits the storage permission signal to the coin change machine 1, to perform storage permission of a coin to be received in the coin change machine 1 into the storage device 8, to the coin change machine 1. When the storage permission signal is transmitted, the processing of the control device 400 returns to the step S11. In addition, when it is judged that the operation to instruct storage rejection has been performed (No in step S23), the processing of the control device 400 proceeds to a step S25. In the step S25, the control device 400 transmits a storage rejection signal to the coin change machine 1, using the communication device 26. In addition, the storage rejection signal is a signal indicating storage rejection which rejects that the coin change machine 1 stores a coin to be received in the coin change machine 1 in the storage device 8. That is, the control device 400 transmits the storage rejection signal to the coin change machine 1, to perform storage rejection of a coin to be received in the coin change machine 1 into the storage device 8, to the coin change machine 1. When the storage rejection signal is transmitted, the processing of the control device 400 returns to the step S11.

On the other hand, when it is judged that the storage permission request signal of a coin has not been received (No in step S21), the processing of the control device 400 proceeds to a step S26. In the step S26, the control device 400 judges whether or not to have received a money payment permission request signal described later from the coin change machine 1. When it is judged that the money payment permission request signal has been received (Yes in step S26), the processing of the control device 400 proceeds to a step S27. In the step S27, the control device 400 displays the money payment permission request screen 345 on the display device for operator 34. The money payment permission request screen 345 to be displayed on the display device for operator 34 will be described later with reference to FIG. 10. Next, in the step S28, the control device 400 judges whether or not an operation to instruct money payment permission has been performed, based on the above-described displayed money payment permission request screen 345. When it is judged that the operation to instruct money payment permission has been performed (Yes in step S28), the processing of the control device 400 proceeds to a step S29. In the step S29, the control device 400 transmits the money payment permission signal to the coin change machine 1, using the communication device 26. In addition, the money payment permission signal is a signal indicating money payment permission which permits money payment of a coin from the storage device 8. That is, the control device 400 transmits the money payment permission signal to the coin change machine 1, to perform money payment permission of a coin from the storage device 8 to the coin change machine 1. When the money payment permission signal is transmitted, the processing of the control device 400 returns to the step S11. In addition, when it is judged that an operation to instruct money payment rejection has been performed (No in step S28), the processing of the control device 400 proceeds to a step S30. In the step S30, the control device 400 transmits a money payment rejection signal to the coin change machine 1, using the communication device 26. In addition, the money payment rejection signal is a signal indication money payment rejection to reject money payment of a coin from the storage device 8. That is, the control device 400 transmits the money payment rejection signal to the coin change machine 1, to perform money payment rejection of a coin from the storage device 8, to the coin change machine 1. When the money payment rejection signal is transmitted, the processing of the control device 400 returns to the step S11. In addition, when it is judged in the step S26 that the money payment permission request signal has not been received (No in step S26), the processing of the control device 400 returns to the step S11.

Figure 7:
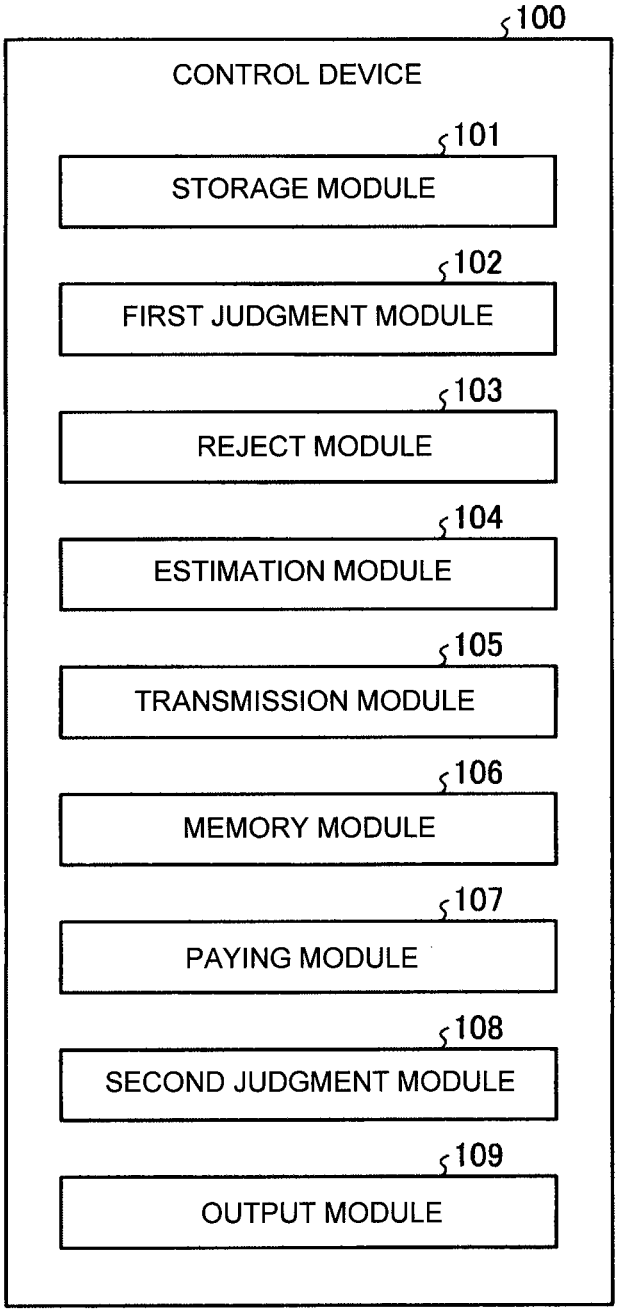
FIG. 7 is a functional block diagram showing a functional configuration of the coin change machine according to the embodiment.

Next, a control processing of the coin change machine 1 will be described. FIG. 7 is a block diagram showing a functional configuration of the coin change machine 1. The CPU 51 executes the control programs stored in the ROM 52 and the control program partition 541 of the memory device 54, and thereby the control device 100 functions as a storage module 101, a first judgment module 102, a reject module 103, an estimation module 104, a transmission module 105, a memory module 106, a paying module 107, a second judgment module 108, and an output module 109.

The storage module 101 has a function to convey a received coin and store it in the storage device 8. Specifically, to begin with, the storage module 101 judges whether or not a coin has been inputted from the coin input port 3, in accordance with the detection result of the coin detection device 18. When judging that a coin has been inputted from the coin input port 3, the storage module 101 drives the take-in and conveying device (flat belt) 3*a*. Further, the storage module 101 controls the drive of the received money conveying device 9, to store the coin in the storage 20 of the storage device 8 (for example, refer to steps S43, S44).

The first judgment module 102 has a function to judge that the received coin is not a normal coil, in accordance with the detection result of the received money discrimination device 10. That is, when only an output of any one kind of the sensor among the output of the above-described outer diameter sensor, the output of the above-described material sensor, the output of the above-described thickness sensor of the received money discrimination device 10, is an output out of the above-described normal data range stored in the normal coin information partition 542, the first judgment module 102 judges that the received coin is not a normal coin (for example, refer to No in step S34 described later).

The reject module 103 has a function to reject a coin which is judged not to be a normal coin. That is, the reject module 103 controls the drive of the reject device 11, so that a coin which has been judged not to be a normal coin by the first judgment module 102 is rejected from the conveying path 9*c*. Specifically, the reject module 103 controls the reject device 11 so that the reject hole 11*a* is opened by the shutter 11*b*, in order to reject the above-described coin which has been judged not to be a normal coin from the conveying path 9*c*, (for example, refer to step S35 described later). In addition, the reject module 103 has a function not to reject the coin which has been received again, from the conveying path 9*c* when storage of the coin is permitted, in relation to the rejection of a coin. Specifically, after the above-described coin judged not to be a normal coin has been rejected, when the above-described storage permission signal is received, the reject module 103 controls the drive of the reject device 11, so that the coin which has been received again is not rejected from the conveying path 9*c* but is conveyed, (for example, refer to step S43 described later). Specifically, the reject module 103 controls the reject device 11 so that the reject hole 11*a* is closed by the shutter 11*b*, in order to convey the above-described coin which has been received again without rejecting it. In addition, the reject module 103 controls the drive of the reject device 11, so that the coin which has been judged to be a normal coin by a normal coin judgment module described later is conveyed without being rejected from the conveying path 9*c*. Specifically, the reject module 103 controls the reject device 11 so that the reject hole 11*a* is closed by the shutter 11*b*, in order to convey the above-described coin which has been judged to be a normal coin without rejecting it.

Regarding a coin which has been judged not to be a normal coin by the first judgment module 102, and has been rejected from the conveying path 9*c* by the reject module 103, the estimation module 104 has a function to estimate whether such a coin is a normal coin. The estimation module 104 will be described in detail. For example, regarding a coin in which outputs of the two kinds of sensors among the above-described three kinds of sensors of the received money discrimination device 10 are within the above-described normal data ranges, and an output of the remaining one kind of sensor is slightly out of the above-described normal data range, such a coin is judged not to be a normal coin by the first judgement module 102. However, the coin in this case may possibly be a coin which is slightly deformed for some reason. Specifically, a case that the output of the above-described outer diameter sensor and the output of the above described material sensor are within the above-described normal data ranges, but only the output of the above-described thickness sensor is slightly out of the normal data range is supposed, for example. The coin in this case may possibly be a normal coin which is slightly abraded in the thickness direction. That is, a coin which may possibly be a normal coin is included, among the coins which are judged not to be normal coins by the first judgment module 102. Accordingly, the estimation module 104 estimates whether a coin which has been judged not to be a normal coin by the first judgment module 102 is a normal coin (for example, refer to step S36 described later). And in the case that the outputs of the above-described two kinds of sensors (for example the output of the above-described outer diameter sensor and the output of the above-described material sensor) are within the above-described normal data range, and the output of the remaining one kind of sensor (for example, the output of the above-described thickness sensor) is slightly out of, by a prescribed value out of, for example, the above-described normal data range, the estimation module 104 judges that it is possible to estimate that the relevant coin is a normal coin. That is, the estimation module 104 estimates that the relevant coin is a normal coin (for example, refer to Yes in step S37 described later).

The transmission module 105 has a function to transmit a storage permission request signal of the received coin to the POS terminal 31, provided that the reject module 103 has rejected the coin. Specifically, when a coin has been rejected by the reject module 103, the transmission module 105 transmits a storage permission request signal to the POS terminal 31, via the communication device 27. In addition, the storage permission request signal is a signal indicating a request of storage permission which permits storing a coin to be received into the storage device 8. That is, the transmission module 105 transmits the storage permission request signal to the POS terminal 31, to perform a request of permission of storing the coin to be received in the storage device 8, to the POS terminal 31 (for example refer to step S38 described later).

The memory module 106 has a function to store the characteristic of a coin detected by the received money discrimination device 10. Specifically, when it is estimated by the above-described estimation module 104 that the received coin is a normal coin (for example, refer to Yes in step S37 described later), and the storage permission signal has been received (for example, refer to Yes in step S39 described later), the memory module 106 stores the outputs of the above-described three kinds of sensors of the received money discrimination device 10 in the memory partition 543 of the memory device 54 (for example, refer to step S42 described later).

The paying module 107 has a function to pay a coin stored in the storage device 8. Specifically, the paying module 107 controls the paying money conveying device 23 so that the coin stored in the storage device 8 is conveyed on the paying route 23*a* by the paying belt 23*b*, and is paid from the coin paying port 4 (for example, refer to steps S52, S58 described later)

The second judgment module 108 has a function to judge that the characteristic of the coin detected by the paying money discrimination device 22 and the characteristic of the coin stored by the memory module 106 are coincident or values close to each other. Specifically, the second judgment module 108 judges that the outputs of the above-described three kinds of sensors of the paying money discrimination device 22 and the outputs of the above-described three kinds of sensors of the received money discrimination device 10 are coincident or values close to each other. (for example, refer to Yes in step S55 described later).

The output module 109 has a function to output information for displaying a message of attention reminder for the coin paid by the paying module 107, provided that it is judged by the second judgment module 108 that the these outputs are coincident or values close to each other as described above. Specifically, when it is judged by the second judgment module 108 that the these outputs are coincident or values close to each other as described above (refer to Yes in step S55 described later), the output module 109 transmits a money payment permission request signal to the POS terminal 31, via the transmission device 27. In addition, the money payment permission request signal is a signal indicating a request of money payment permission which permits money payment of a coin from the storage device 8. That is, the output module 109 performs a request of permission of money payment of a coin from the storage device 8, as information output for displaying the above-described message of attention reminder, (for example, refer to step S56 described later).

In addition, the control device 100 functions as a normal coin judgment module, a denomination judgment module, a denomination estimation module, a normal coin estimation impossibleness judgment module, a denomination estimation impossibleness judgment module, in addition to the function modules 101-109 as described above. That is, when all of the output of the above-described outer diameter sensor, the output of the above-described material sensor, and the output of the above-described thickness sensor of the received money discrimination device 10 are within the above-described normal data ranges stored in the normal coin information partition 542, the control device 100 (normal coin judgment module) judges that the coin which has passed through the received money discrimination device 10, that is, the received coin is a normal coin (for example, refer to Yes in step S34 described later). Further, when all of the output of the above-described outer diameter sensor, the output of the above-described material sensor, and the output of the above-described thickness sensor of the paying money discrimination device 22 are within the above-described normal data ranges stored in the normal coin information partition 542, the control device 100 (normal coin judgment module) judges that the coin which has passed through the paying money discrimination device 22, that is, the paid coin is a normal coin (for example, refer to Yes in step S54 described later).

In addition, the control device 100 (denomination judgment module) judges a denomination of the coin which has been judged to be a normal coin by the above-described normal coin judgment module. For example, when the output of the above-described outer diameter sensor of the received money discrimination device 10 is a value within the above-described normal data range A1-A2, the output of the above-described material sensor is a value within the above-described normal data range B1-B2, the output of the above-described thickness sensor is a value within the above-described normal data range C1-C2, the control device 100 (denomination judgment module) judges that the received coin is a 1-yen coin. In addition, when the output of the outer diameter sensor of the paying money discrimination device 22 is a value within the above-described normal data range A1-A2, the output of the material sensor is a value within the above-described normal data range B1-B2, the output of the thickness sensor is a value within the above-described normal data range C1-C2, the control device 100 (denomination judgment module) judges that the paid coin is a 1-yen coin. In addition, the control device 100 can also judge a denomination of the paid coin, in accordance with from what storage 20 out of a plurality of the storages 20 (refer to FIG. 2) the coin has been paid, for example. That is, the control device 100 can also judge a denomination of the paid coin, in accordance with by what paying money discrimination device 22 out of a plurality of the paying money discrimination devices 22 (refer to FIG. 2) corresponding to a plurality of the storages 20, money payment of the coin has been detected. For example, in the case that it is not judged by the second judgment module 108 that the these outputs are coincident or values close to each other as described above (refer to No in step S55 described later), when a coin is to be paid again (refer to step S58 described later), a denomination of the coin to be paid again is judged in accordance with by what above-described paying money discrimination device 22 money payment of the coin has been detected.

In addition, the control device 100 (denomination estimation module) estimates a denomination of the coin which has been estimated to be a normal coin by the estimation module 104. For example, when the output of the above-described outer diameter sensor of the received money discrimination device 10 is a value within the above-described normal data range A1-A2, the output of the above-described material sensor is a value within the above-described normal data range B1-B2, but the output of the above-described thickness sensor is slightly out of, by a prescribed value out of, for example, the above-described normal data range C1-C2, the control device 100 (denomination estimation module) estimates that the received coin is a normal coin, and is also a one-yen coin. In addition, a storage permission request signal is transmitted (refer to step S38 described later), for example, based on the denomination to be estimated by the outputs of the three kinds of sensors of the received money discrimination device 10. In addition, when it is judged that the these outputs are coincident or values close to each other by the second judgment module 108 as described above (refer to Yes in step S55 described later), the control device 100 (denomination estimation module) can also estimate a denomination of the paid coin, based on the outputs of the three kinds of the sensors of the paying money discrimination device 22 which have been judged to be coincident or values close to each other as described above. For example, a money payment permission request signal is transmitted (refer to step S56 described later), based on the denomination which has been estimated by the outputs of the paying money discrimination device 22. Further, in the case that the money payment permission signal is received (Yes in step S57 described later), when a coin is to be paid again (refer to step S58 described later), a denomination of the coin to be paid again is estimated by the outputs of the paying money discrimination device 22.

In addition, the control device 100 (normal coin estimation impossibleness judgment module), regarding the coin which has been judged not to be a normal coin by the first judgment module 102, judges it impossible to estimate that such a coin is a normal coin (for example, refer to No in step S37 described below). For example, when the output of only one kind of the sensor of the received money discrimination device 10 is within the normal range, there is no possibility that the coin which has been detected by the received money discrimination device 10 is a normal coin. Accordingly, when the output of only one kind of the sensor of the received money discrimination device 10 is within the above-described normal data range, the control device 100 (normal coin estimation impossibleness judgment module) judges it impossible to estimate that the relevant coin is a normal coin. In addition, for example, even in the case that the outputs of two kinds of the sensors of the received money discrimination device 10 are within the normal ranges, when the output of the remaining one kind of the sensor is largely out of the above-described normal data range, there is no possibility that the coin which has been detected by the received money discrimination device 10 is a normal coin. Accordingly, even in the case that the outputs of two kinds of the sensors of the received money discrimination device 10 are within the normal ranges, when the output of the remaining one kind of the sensor is largely out of the above-described normal data range, the control device 100 (normal coin estimation impossibleness judgment module) judges it impossible to estimate that the relevant coin is a normal coin. As a matter of course, the outputs of any sensors of the received money discrimination device 10 are not within the above-described normal data ranges, the control device 100 (normal coin estimation impossibleness judgment module) judges it impossible to estimate that the relevant coin is a normal coin. Further, regarding the coin in which it is judged impossible to estimate the coin to be a normal coin by the above-described normal coin estimation impossibleness judgment module, the control device 100 (denomination estimation impossibleness judgment module) judges it impossible to estimate a denomination of the coin.

Figure 8:
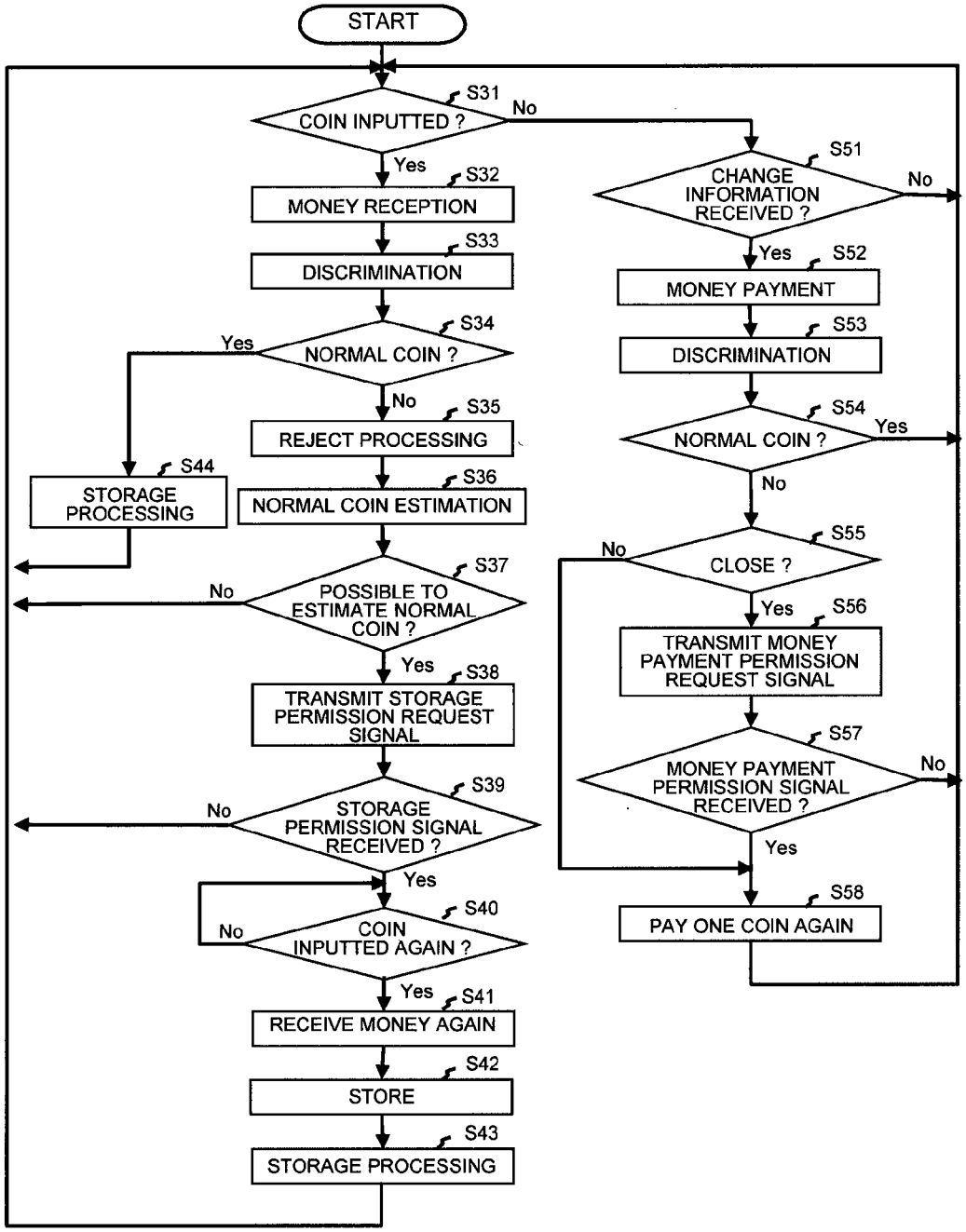
FIG. 8 is a flow chart showing a control processing of the coin change machine according to the embodiment.

FIG. 8 is a flow chart showing a control processing of the coin change machine 1. In a step S31 shown in FIG. 8, the control device 100 firstly judges whether or not a coin has been inputted from the coin input port 3, using the coin detection device 18. When it is judged that a coin has been inputted (Yes in step S31), the processing of the control device 100 proceeds to a step S32. In the step S32, the control device 100 drives the take-in and conveying device (flat belt) 3*a* and the received money conveying device 9, to receive the coin in the coin change machine 1. Next, in a step S33, the control device 100 compares the output of the above-described outer diameter sensor, the output of the above-described material sensor, and the output of the above-described thickness sensor which have been acquired from the received money discrimination device 10 with the above-described normal data ranges (refer to FIG. 5) of the normal coin information partition 542, to perform authenticity discrimination of the received coin. And, in a step S34, the control device 100 (first judgment module 102) judges whether or not the received coin is a normal coin, based on the result of authenticity discrimination of the above-described received coin. When it is judged that the received coin is a normal coin (Yes in step S34), the processing of the control device 100 proceeds to a step S44. In the step S44, the control device 100 (storage module 101) conveys the received coin, and makes the received coin drop from the sorting hole 21 corresponding to its denomination, to store the received coin in the storage 20 corresponding to the denomination of the coin. After the received coin has been stored, the processing of the control device 100 returns to the step S31. On the other hand, when it is judged that the received coin is not a normal coin (No in step S34), the processing of the control device 100 proceeds to a step S35. In the step S35, the control device 100 (reject module 103) makes the shutter 11*b* of the reject device 11 to be opened, to execute a reject processing to reject the relevant coin.

Next in a step S36, the control device 100 (estimation module 104) estimates whether the rejected coin is a normal coin. And in a step S37, the control device 100 judges whether or not it is possible to estimate that the coin is a normal coin. When it is judged possible to estimate that the coin is a normal coin (Yes in step S37), the processing of the control device 100 proceeds to a step S38. In the step S38, regarding the coin in which it is judged possible to estimate that the coin is a normal coin, the control device 100 (denomination estimation module) estimates a denomination of the coin as described above. The control device 100 (transmission module 105) transmits the above-described storage permission request signal, along with the information of the above-described estimated denomination of the coin to the POS terminal 31. The POS terminal 31 which has received the storage permission request signal displays the storage permission request screen 341 on the display device for operator 34 (refer to step S22 of FIG. 6).

Figure 9:
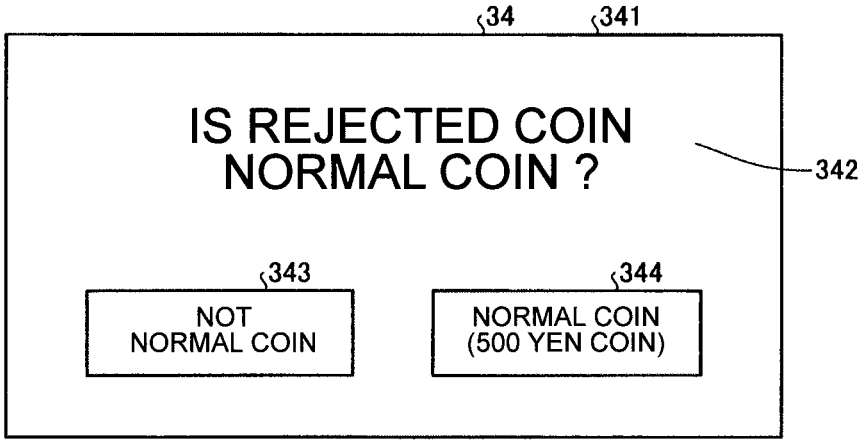
FIG. 9 is a diagram showing a storage permission request screen to be displayed on the POS terminal according to the embodiment.

FIG. 9 is a diagram showing the storage permission request screen 341 which the POS terminal 31 displays. The control device 400 of the POS terminal 31 displays the storage permission request screen 341 shown in FIG. 9 on the display device for operator 34. The storage permission request screen 341 displays a message 342 to request an operator to confirm whether or not the coin which has been rejected in the step S35 is a normal coin, such as a character string "is rejected coin normal coin?". In addition, the storage permission request screen 341 displays a button 343 which an operator operates when the operator has judged that the above-described rejected coin is not a normal coin, and a button 344 which an operator operates when the operator has judged that the coin is a normal coin. Further, the storage permission request screen 341 displays a message, such as a character string "not normal coin" indicating that the button 343 is a button which an operator operates when the operator has judged that the above-described rejected coin is not a normal coin, on the button 343. In addition, the storage permission request screen 341 displays a message including the denomination (refer to step S38) which has been estimated by the control device 100 of the coin change machine 1 on the button 344. For example, when the denomination which has been estimated by the control device 100 of the coin change machine 1 is a 500-yen coin, the storage permission request screen 341 displays a character string "it is 500-yen", as a message including the denomination, on the button 344. The operator compares the coin which has been discharged from the reject port 6 with the coin (in the case of FIG. 9, 500-yen coin) of the message displayed on the button 344 with the eye, and judges whether the rejected coin is a normal coin or not a normal coin. And when having judged that the rejected coin is a normal coin, the operator operates the button 344. When the button 344 is operated, the control device 400 of the POS terminal 31 transmits the storage permission signal to the change coin machine 1 (refer to step S24 of FIG. 6). On the other hand, when having judged that the rejected coin is not a normal coin, the operator operates the button 343. When the button 343 is operated, the control device 400 of the POS terminal 31 transmits the storage rejection signal to the coin change machine 1 (refer to step S25 of FIG. 6).

The description will be returned to FIG. 8. In a step S39, the control device 100 judges whether to have received the storage permission signal from the POS terminal 31 or to have received the storage rejection signal, as a response to the storage permission request signal to the POS terminal 31. When it is judged that the storage permission signal has been received (Yes in step 39), the processing of the control device 100 proceeds to a step S40. In the step S40, the control device 100 judges whether or not the coin has been inputted again, and waits until the coin is inputted again (No in step S40). When it is judged that the coin has been inputted again (Yes in step S40), the processing of the control device 100 proceeds to a step S41. In the step S41, the control device 100 makes the coin which has been inputted again to be received in the coin change machine 1 according to the storage permission signal. In a step S42, the control device 100 (memory module 106) stores the outputs of the respective sensors of the received money discrimination device 10 which have been used for authenticity discrimination of a coin in the above-described step S33 in the memory partition 543. In a step S43, the control device 100 closes the shutter 11*b* of the reject device 11. And the control device 100 makes the coin to be conveyed on the conveying path 9*c* pass through, without rejecting the coin from the conveying path 9*c* by the reject device 11. Next, the control device 100 (storage module 101) makes the coin which has been conveyed on the conveying path 9*d* drop from the sorting hole 21 corresponding to the denomination of the coin, to store it in the storage 20 corresponding to the denomination of the coin. After the coin has been stored in the storage 20, the processing of the control device 100 returns to the step S31.

In addition, when it is judged impossible to estimate that the above-described rejected coin is a normal coin (No in step S37), the processing of the control device 100 returns to the step S31. In addition, when the storage rejection signal from the POS terminal 31 is received in the step S39 (No in step S39), the processing of the control device 100 returns to the step S31.

On the other hand, when it is judged that a coin has not been inputted in the step S31 (No in step S31), the processing of the control device 100 proceeds to a step S51. In the step S51, the control device 100 judges whether or not to have received the change information (refer to step S16 of FIG. 6) from the POS terminal 31. When it is judged that the change information has been received (Yes in step S51), the processing of the control device 100 proceeds to a step S52. In the step S52, the control device 100 (paying module 107) controls the paying money conveying device 23, to pay change based on the received change information from the coin paying port 4 on the saucer 5. And in a step S53, the control device 100 compares the output of the above-described outer diameter sensor, the output of the above-described material sensor, and the output of the above-described thickness sensor which have been acquired from the paying money discrimination device 22, with the above-described normal data ranges (refer to FIG. 5) of the normal coin information partition 542, to perform authenticity discrimination of the paid coin. And in a step S54, the control device 100 judges whether or not the paid coin is a normal coin, based on the result of authenticity discrimination of the above-described paid coin. When it is judged that the coin is not a normal coin (No in step S54), the processing of the control device 100 proceeds to a step S55. In the step S55, the control device 100 compares the outputs of the respective sensors of the paying money discrimination device 22 used for authenticity discrimination of the coin in the above-described step S53 with the outputs of the received money discrimination device 10 stored in the memory partition 543 in the above-described step S42. And the control device 100 (second judgment module 108) judges whether the both outputs are coincident or values close to each other. When it is judged that both of the outputs are coincident or values close to each other (Yes in step S55), the processing of the control device 100 proceeds to a step S56. In the step S56, regarding the coin which has been paid in the above-described step S52, the control device 100 (output module 109) judges a denomination thereof to be estimated as described above. The control device 100 transmits a money payment permission request signal to the POS terminal 31, based on the information of the judged denomination. The POS terminal 31 which has received the money payment permission request signal displays the money payment permission request screen 345 on the display device for operator 34 (refer to step S27 of FIG. 6). An operator judges authenticity of the coin paid from the coin paying port 4, based on the money payment permission request screen 345. Transmission of the money payment permission request like this is transmission of information for displaying a massage indicating attention reminder to an operator.

Figure 10:
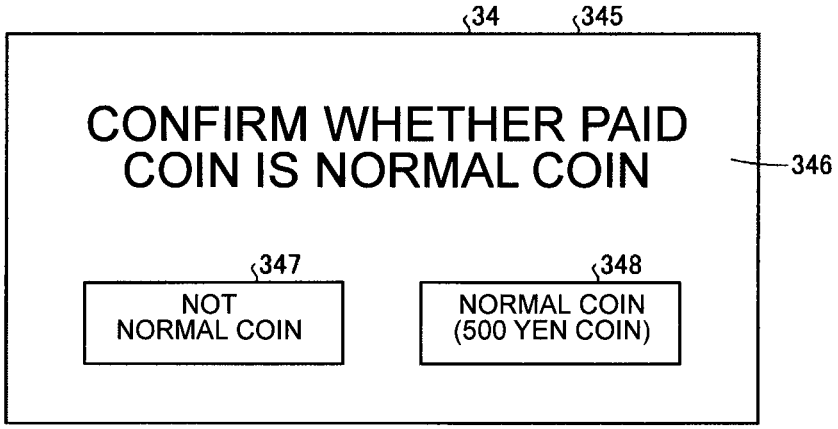
FIG. 10 is a diagram showing a money payment permission request screen to be displayed on the POS terminal according to the embodiment.

FIG. 10 is a diagram showing the money payment permission request screen 345 which the POS terminal 31 displays. The control device 400 of the POS terminal 31 displays the money payment permission request screen 345 shown in FIG. 10 on the display device for operator 34. The money payment permission request screen 345 displays a message 346 of attention reminder to request an operator to confirm whether or not the coin which has been paid in the above-described step S52 is a normal coin, such as a character string "confirm whether paid coin is normal coin". In addition, the money payment permission request screen 345 displays a button 347 which an operator operates when the operator has judged that the coin is not a normal coin, and a button 348 which an operator operates when the operator has judged that the coin is a normal coin. Further, the money payment permission request screen 345 displays a message, such as a character string "not normal coin" indicating that the button 347 is a button which an operator operates when the operator has judged that the above-described paid coin is not a normal coin on the button 347. In addition, the money payment permission request screen 345 displays a message including the denomination (refer to step S56) which has been estimated by the control device 100 of the coin change machine 1 on the button 348. For example, when the denomination which has been estimated by the control device 100 of the coin change machine 1 is 500-yen coin, the money payment permission request screen 345 displays a character string "it is 500-yen", as a message including the denomination, on the button 348. An operator compares the coin which has been paid from the coin paying port 4, with the coin (in the case of FIG. 10, 500-yen coin) of the message displayed on the button 348 with the eye, and judges whether the relevant coin is a normal coin or not a normal coin. And, when having judged that the relevant coin is a normal coin, the operator operates the button 348. When the button 348 is operated, the control device 400 of the POS terminal 31 transmits a money payment rejection signal to the change coin machine 1 (refer to step S30 of FIG. 6). On the other hand, when having judged that the relevant coin is not a normal coin, the operator operates the button 347. When the button 347 is operated, the control device 400 of the POS terminal 31 transmits a money payment permission signal to the coin change machine 1 (refer to step S29 of FIG. 6).

The description will be returned to FIG. 8. In a step S57, the control device 100 judges whether to have received the money payment permission signal from the POS terminal 31 or to have received the money payment rejection signal therefrom. When it is judged that the money payment permission signal have been received (Yes in step S57), the processing of the control device 100 proceeds to a step S58. In the step S58 (pay one coin again), the control device 100 controls the paying money conveying device 23, to pay one coin of the denomination which has been estimated in the above-described step S56 from the coin paying port 4. When the coin is paid from the coin paying port 4 in the step S58, the processing of the control device 100 returns to the step S31. In addition, when it is judged that the coin which has been paid in the above-described step S52 is not a normal coin (No in step S54), and when the outputs of the respective sensors of the paying money discrimination device 22 used for authenticity discrimination of a coin in the above-described step S53 and the outputs from the received money discrimination device 10 stored in the memory partition 543 in the above-described step S42 are not coincident or not values close to each other (No in step S55), the control device 100 executes the processing of the above-described step S58.

When having judged that the paid coin is a normal coin in the money payment permission request screen 345, namely when having operated the button 348, an operator hands over the coin paid in the above-described step S52 to a customer as change. In addition, when having judged that the paid coin is not a normal coin in the money payment permission request screen 345, namely when having operated the button 347, an operator hands over the coin paid in the above-described step S58 to a customer as change.

Further, when it is judged that the change information has not been received in the step S51 (No in step S51), the processing of the control device 100 returns to the step S31.

In addition, when it is judged that the above-described paid coin (refer to step S52) is a normal coin in the step S54 (Yes in step S54), the processing of the control device 100 returns to the step S31. In this case (Yes in step S54), an operator hands over the coin paid in the step S52 to a customer as change. Accordingly, the coin change machine 1 need not pay a coin again, as in the above-described step S58. In addition, when it is judged that the money payment rejection signal from the POS terminal 31 has been received in the step S57 (No in step S57), the processing of the control device 100 returns to the step S31. The case that the above-described money payment rejection signal has been received (No in step S57) is a case that an operator judges that the paid coin is a normal coin in the money payment permission request screen 345, and operates the button 348. In this case, the operator hands over the coin paid in the step S52 as change as described above. Accordingly, the coin change machine 1 need not pay a coin again, as in the above-described step S58.

According to the embodiment described above, regarding the coin which has been rejected once by the reject device 11 and has been discharged on the saucer 7, when the storage permission signal of such a coin from the POS terminal 31 has been received in accordance with an operation instruction of an operator in the POS terminal 31, the control device 100 stores the relevant coin in the storage device 8 without rejecting the relevant coin again (refer to step S35 to step S43). Accordingly, at the time of storing a coin received from a customer as its price in the coin change machine, a store need not prepare reserve in place of the coin rejected by the reject device 11.

For example, in the embodiment, the coin change machine 1 has been described as a money reception device, but without being limited to this, a bill change machine to store a bill may be used as a money reception device. In addition, in a money reception device, a function to pay a coin is not an essential requirement.

In addition, in the embodiment, the coin change machine 1 connected to the POS terminal 31 has been described as a money reception device, but a money reception device is not limited to this. For example, a money reception device may be one device in which a function of the POS terminal 31, and a function of a bill change machine and a coin change machine are incorporated. That is, a money reception device may be a self-POS terminal which incorporates the above-described functions and a customer himself/herself operates. In addition, a money reception device may be a semi self-system provided with an accounting device in which a customer himself/herself performs an accounting processing. Hereinafter, a POS terminal and a semi self-system are collectively called "a self-POS terminal". In this case, in the self-POS terminal, when a customer who has purchased a commodity deposits money as its price into the self-POS terminal, the reject module rejects money which the first judgment module has judged not to be a normal coin. In this case, an attendant who monitors the self-POS terminal confirms the rejected money. And when the attendant has judged that the relevant money is normal coin, the attendant transmits a signal to permit storage from a PC of the attendant to the self-POS terminal. The customer deposits the rejected money again. The self-POS terminal (storage module) which has received the signal to permit storage stores the money which has been deposited again in the storage device.

In addition, in the embodiment, the storage permission request screen 341 has been displayed on the display device for operator 34 of the POS terminal 31, but without being limited to this, the storage permission request screen 341 may be displayed on the display device 16 of the coin change machine 1.

In addition, in the embodiment, when outputs from the two kind of sensors are the outputs within the above-described normal ranges stored in the normal coin information partition 542, and an output from the remaining one kind of sensor is slightly out of the above-described normal data range, the control device 100 estimates that the relevant coin is a normal coin. The above-described normal data range of the normal coin information partition 542 in this case may be arbitrarily determined.

In addition, in the embodiment, the authenticity and denomination of a coin are judged based on the outputs of outer diameter sensors, material sensors and thickness sensors provided in the received money discrimination device 10 and the paying money discrimination device 22. However, the judgments of the authenticity and denomination of a coin are not limited to this. The authenticity and denomination of a coin may be judged, based on outputs of any of the above-described sensors, or outputs from a proper combination thereof. In addition, the authenticity and denomination of a coin may be judged, by comparing an image such as a drawing pattern of a coin which an imaging device has imaged, with a previously stored image, for example.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A money reception device, comprising:

a received money conveying device which conveys received money via a conveying path;

a storage device which stores the money to be conveyed by the received money conveying device;

a first detection device which detects characteristic of the money to be conveyed by the conveying device;

a reject device which rejects the money that has been judged not to be a normal coin out of the moneys to be conveyed by the conveying device, from the conveying path;

an interface which receives storage permission to permit storing of the money to be received again after the money has been rejected from the conveying path by the reject device, in the storage device; and a control device which judges whether the money is not a normal coin, based on a detection result of the first detection device, controls the reject device so that the money which has been judged not to be a normal coin is rejected from the conveying path, when it has been judged that the money is not a normal coin, and controls the reject device so that the money to be received again passes through the conveying path without being rejected, when the interface has received the storage permission.

2. The money reception device according to claim 1, wherein:

the control device estimates, regarding the money which has been judged not to be a normal coin and has been rejected by the reject device, whether the money is a normal coin, and when having estimated that the rejected money is a normal coin, the control device controls the reject device so that the money to be received again passes through the conveying path without being rejected.

3. The money reception device according to claim 2, wherein:

the first detection sensor has an outer diameter sensor to detect an outer diameter of the money as the characteristic of the money, a material sensor to detect material of the money as the characteristic of the money, and a thickness sensor to detect a thickness of the money as the characteristic of the money.

4. The money reception device according to claim 3, wherein:

the control device judges that the money to be received is not a normal coin when detection results of all of the outer diameter sensor, the material sensor, and the thickness sensor of the first detection device are out of previously stored normal data ranges.

5. The money reception device according to claim 4, wherein:

the control device estimates the money which has been judged not to be a normal coin and has been rejected to be a normal coin, when only the detection result of a prescribed sensor out of the detection results of the outer diameter sensor, the material sensor, and the thickness sensor of the first detection device is slightly out of the normal data range.

6. The money reception device according to claim 5, wherein:

the control device estimates the money which has been judged not to be a normal coin and has been rejected, to be a normal coin, when only the detection result of the thickness sensor of the first detection device is slightly out of the normal data range.

7. The money reception device according to claim 1, wherein:

the interface includes a communication device to communicate with an external device, and the control device transmits a request of the storage permission to the external device via the communication device, when the received money has been judged not to be a normal coin and has been rejected by the reject device.

8. The money reception device according to claim 7, wherein:

the control device controls the reject device and the received money conveying device so that the money to be received again passes through the conveying path without being rejected, when the control device has received the storage permission from the external device as a response to the request of the storage permission.

9. The money reception device according to claim 1, wherein:

the reject device has a reject hole provided in the conveying path, and a shutter to open or close the reject hole; and the control device controls the reject device so that the reject hole is opened by the shutter, in order to reject the money which has been judged not to be a normal coin.

10. The money reception device according to claim 9, wherein:

the control device controls the reject device so that the reject hole is closed by the shutter, in order to store the money which has been received again in the storage device.

11. The money reception device according to claim 1, further comprising:

a memory device which stores the characteristic of the money detected by the first detection device;

a paying money conveying device which pays the money stored by the storage device; and a second detection device which detects characteristic of the money to be paid by the paying money conveying device;

wherein the control device judges whether the paid money is not a normal coin, based on a detection result of the second detection device.

12. The money reception device according to claim 11, wherein:

the control device judges whether the characteristic of the money detected by the second detection device and the characteristic of the money stored in the memory device are coincident or are values close to each other, when the control device has judged that the paid money is not a normal coin, and controls the paying money conveying device so that the money stored by the storage device is paid again, when it is judged that the both characteristics are coincident or values close to each other.

13. The money reception device according to claim 12, wherein:

the interface includes a communication device to communicate with an external device, and the control device transmits a request of permission of money payment to pay the money stored by the storage device again to the external device via the communication device, when it is judged that the both characteristics are coincident or values close to each other.

14. The money reception device according to claim 13, wherein:

the control device transmits the request of the permission of money payment to the external device via the communication device, as a message of attention reminder for the money which has been paid by the paying money conveying device.

* * * * *